US007628621B2

(12) United States Patent
Tsai

(10) Patent No.: US 7,628,621 B2
(45) Date of Patent: Dec. 8, 2009

(54) ELECTRIC DEVICE WITH ROTATABLE AND RECEIVABLE PLUG

(75) Inventor: Sung-Nien Tsai, Jhonghe (TW)

(73) Assignee: Phihong Technology Co., Ltd., Taoyuan County (TW)

( * ) Notice: Subject to any disclaimer, the term of this patent is extended or adjusted under 35 U.S.C. 154(b) by 91 days.

(21) Appl. No.: 11/868,544

(22) Filed: Oct. 8, 2007

(65) Prior Publication Data

US 2009/0093163 A1 Apr. 9, 2009

(51) Int. Cl.
*H01R 13/44* (2006.01)
*H01R 13/60* (2006.01)

(52) U.S. Cl. ..... 439/131; 439/171

(58) Field of Classification Search ..... 439/620.21, 439/131, 651, 171–172, 640
See application file for complete search history.

(56) References Cited

U.S. PATENT DOCUMENTS 5,474,464 A * 12/1995 Drewnicki ..... 439/172
6,275,002 B1 * 8/2001 Chen ..... 320/111
6,722,900 B2 * 4/2004 Segawa et al. ..... 439/131
6,780,033 B2 * 8/2004 Liu ..... 439/172
6,935,878 B2 * 8/2005 Hsu et al. ..... 439/171
7,052,298 B1 * 5/2006 Cheng ..... 439/171
7,354,286 B1 * 4/2008 Lee ..... 439/172
7,481,660 B1 * 1/2009 Tsai ..... 439/131

* cited by examiner

*Primary Examiner*—Michael C Zarroli
(74) *Attorney, Agent, or Firm*—Ming Chow Sinorica, LLC

(57) ABSTRACT

The present invention discloses an electric device with a rotatable and receivable plug. The electric device includes an upper case and a lower case. The lower case has two through holes, two plug receiving slots and two receptacles formed therein, and is engaged with the upper case. The electric device further includes a plug having a first end and a second end. The first end is inserted into the through holes of the lower case. Moreover, the first end of the plug is received in the plug receiving slots of the lower case and the second end of the plug is received in the receptacles of the lower case when the plug is rotated to a hidden position. The electric device further includes a fixing member having two slots formed therein to be inserted by the second end of the plug and two clamping fixtures formed on the lower surface thereof to clamp the plug, and a circuit board attached onto the lower case.

12 Claims, 6 Drawing Sheets

Replacement Sheet

ELECTRIC DEVICE WITH ROTATABLE AND RECEIVABLE PLUG

FIELD OF THE INVENTION

The present invention relates to an electric device with a plug, and more particularly to an electric device with an effort-saving, receivable, and rotatable plug.

BACKGROUND OF THE INVENTION

Consumer electronic products, such as notebooks, personal digital assistants (PDA), mobile phones, MP3 players, and so on, are trending toward smaller sizes continuously, which thereby promotes higher demand for easily-portable electric power connectors, for example, a power supply, a battery charger, or a transformer. Therefore, the electric power connectors of consumer electronic products need to be made with smaller sizes and less weight, and more convenient for shipment. Furthermore, they must be durable in order to sustain long-term carrying and frequent usage. Each of the consumer electronic products needs a plug on the electric power connectors or on the product itself to supply power thereto, and thus the plug is a necessary unit. Various kinds of plugs come out recently for the consumer electronic products or the electric power connectors to be carried conveniently, such as rotatable plugs, foldable plugs, or retractable plugs.

For instance, a conventional electric power connector includes a housing and a plug. The housing further has a concave storage confinement near the top edge of the housing. The plug is mainly composed of a rod having a tenon on each side thereof, two first pins and two second pins. The first pins and the second pins respectively have holes corresponding to the tenon for inserting the tenon to make the connection of the first pins, the second pins and the rod. Each side wall of the concave storage confinement has a spring receptacle containing a spring. The ends of the spring are respectively in contact with a side of the spring receptacle and a cavity disposed in each of the first pins via a fixing element. The plug is positioned in the concave storage confinement by the resilience force of the springs and folded by adjusting the first pins to drive the second pins and rotate the rod. Thus, the plug is electrically connected to the circuit board mounted inside the housing.

Many conventional foldable, rotatable or retractable plugs similar to the above plug have a major difficulty in the mechanical design. The conventional foldable or rotatable fixtures usually have weak mechanical structure for attaching to either the housing or other members of the plug connector. The weak attachment structure may cause the foldable or rotatable unit to be damageable, less reliable and even dangerous to the user and may also affect the establishment or maintenance of a good electric contact. Thus, there is still a demand for providing a rotatable or foldable plug that is durable and safe and can overcome the above shortcomings.

SUMMARY OF THE INVENTION

In view of the aforementioned defects of the conventional plugs such as the weak mechanical structure rendering the conventional plug damageable, less reliable and even dangerous to the user, the present invention discloses an electric device with a rotatable, receivable, and durable plug.

The present invention provides an electric device with a rotatable and receivable plug. The electric device includes an upper case and a lower case. The lower case has two through holes, two plug receiving slots and two receptacles formed therein, and is engaged with the upper case. The electric device further includes a plug having a first end and a second end. The first end is inserted into the through holes of the lower case. Moreover, the first end of the plug is received in the plug receiving slots of the lower case and the second end of the plug is received in the receptacles of the lower case when the plug is rotated to a hidden position. The electric device further includes a fixing member having two slots formed therein to be inserted by the second end of the plug and two clamping fixtures formed on the lower surface thereof to clamp the plug, and a circuit board attached onto the lower case. The fixing member further includes two receiving parts formed on the upper surface thereof. The receiving parts and a portion of the slots in the fixing member receive the second end of the plug when the plug is being rotated. The lower case further includes two notches and two concave receptacles formed therein to support the plug. The notches and the concave receptacles are U-shaped. Furthermore, the lower case includes a concave groove formed between the through holes. The plug further includes a rectangular pivot to be camped by the clamping fixtures of the fixing member.

One advantage of the present invention is the rotatable plug which is receivable conveniently into the electric device.

Another advantage of the present invention is the rotatable plug which is effort-saving in use.

Still another advantage of the present invention is the rotatable plug which can meet the safety requirements.

Still another advantage of the present invention is the rotatable plug which is durable and robust by utilizing the fixing member coupled to the lower case and can sustain long-term carrying and frequent usage.

Another advantage of the present invention is that the rotatable plug can be applied to any kinds of electric devices which need an electric plug.

These and other advantages will become apparent from the following description of preferred embodiments taken together with the accompanying drawings and the appended claims.

BRIEF DESCRIPTION OF THE DRAWINGS

The present invention may be understood by some preferred embodiments and detailed descriptions in the specification and the attached drawings below. The identical reference numbers in the drawings refer to the same components in the present invention. However, it should be appreciated that all the preferred embodiments of the invention are only for illustrating but not for limiting the scope of the claims and wherein:

DETAILED DESCRIPTION OF THE PREFERRED EMBODIMENT

The invention will now be described with the preferred embodiments and aspects and these descriptions interpret structure and procedures of the invention only for illustrating but not for limiting the claims of the invention. Therefore, except the preferred embodiments in the specification, the present invention may also be widely used in other embodiments.

Figure 1:
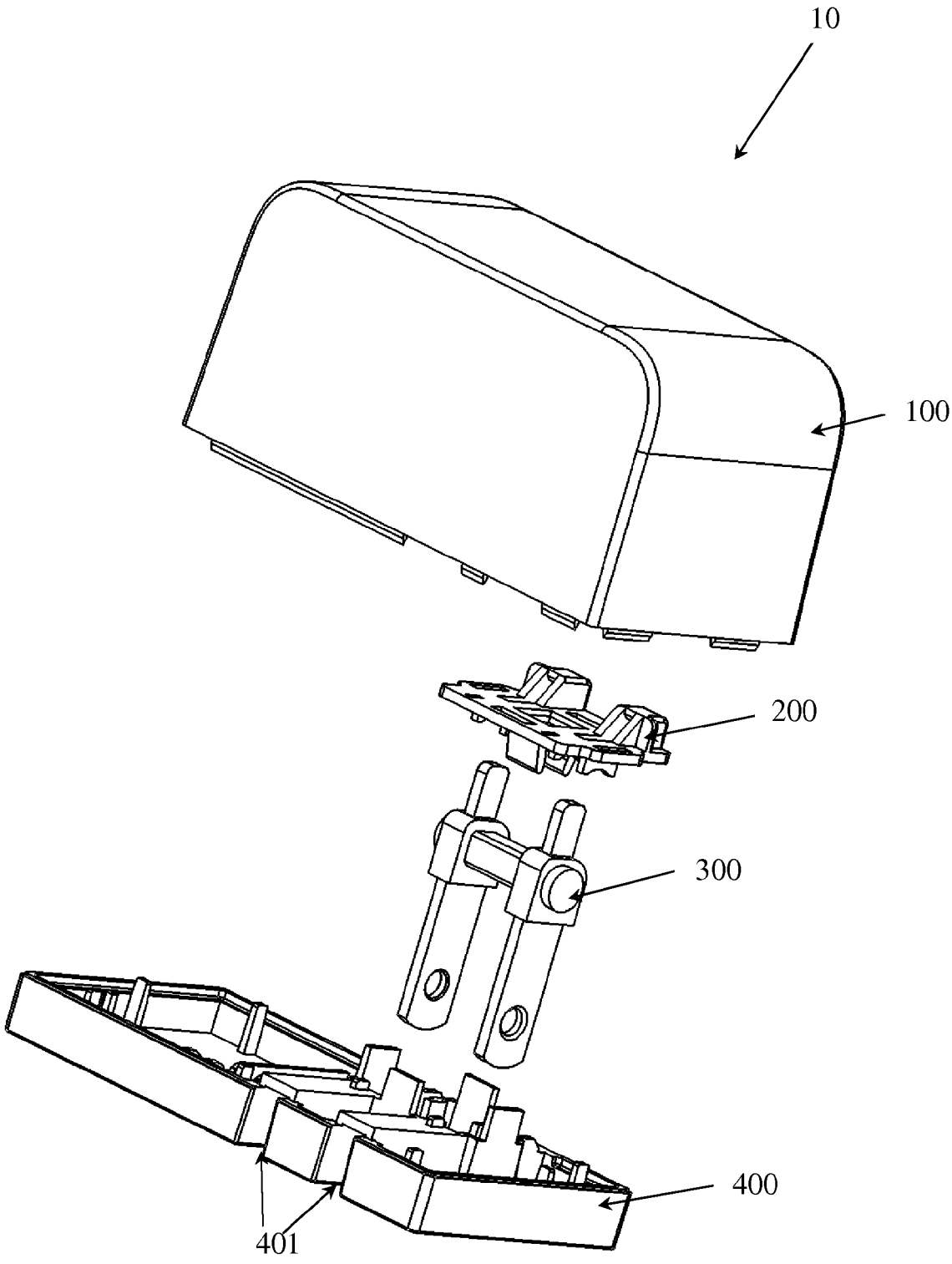
FIG. 1 is a diagram of the electric device according to the present invention.
Figure 5:
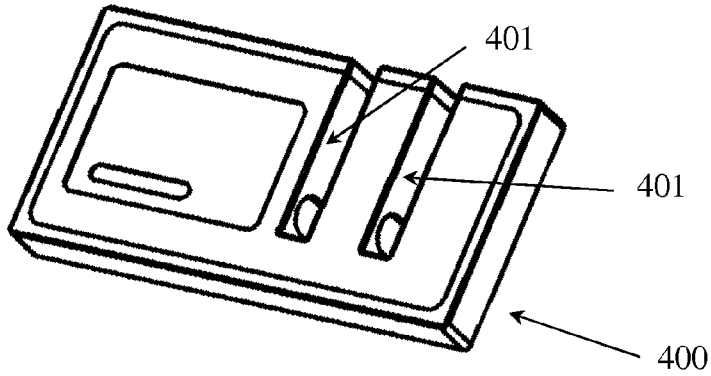
FIG. 5 is a back view diagram of the lower case of the electric device according to the present invention.
Figure 10:
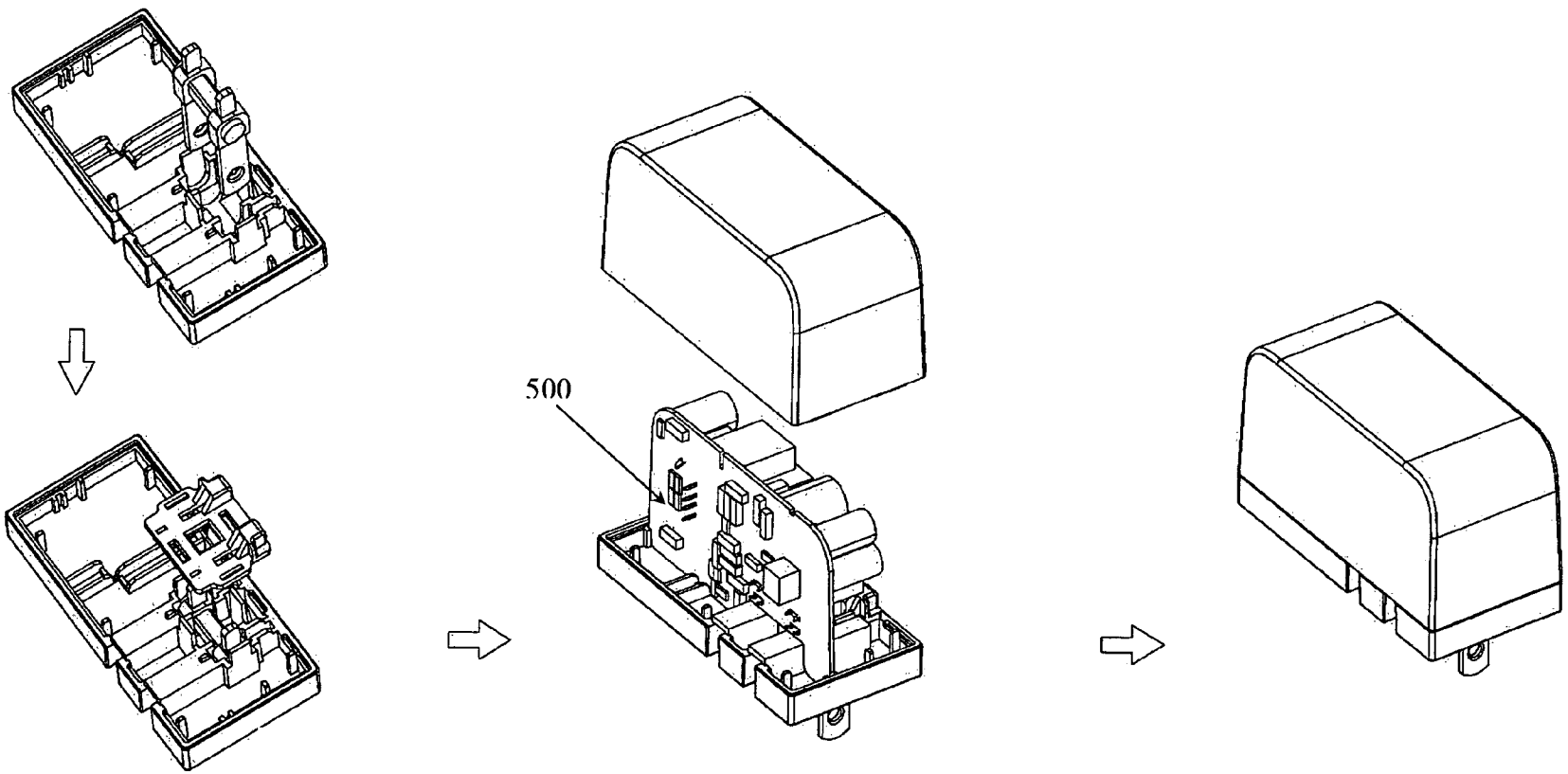
FIG. 10 illustrates the assembling procedure of the electric device according to the present invention.

The present invention discloses an electric device with a rotatable plug. In the preferred embodiment of the present invention, the electric device 10 includes an upper case 100, a lower case 400 mating with the upper case 100, a rotatable rack 300 supported by the lower case 400, a fixing member 200 placed on the rotatable rack 300, and a printed circuit board (PCB) 500 attached on the lower case 400 to electrically connect with the rotatable rack 300 as shown in FIG. 1 and FIG. 10. There are two slots 401 defined in the lower surface of the lower case 400 as shown in FIG. 1 and FIG. 5. The slots 401 are set in parallel and are opened in one end for the rotatable rack 300 passing therethrough and being held therein. In other words, the rotatable rack 300 can be rotated to be received and hidden in the slots 401.

Figure 6:
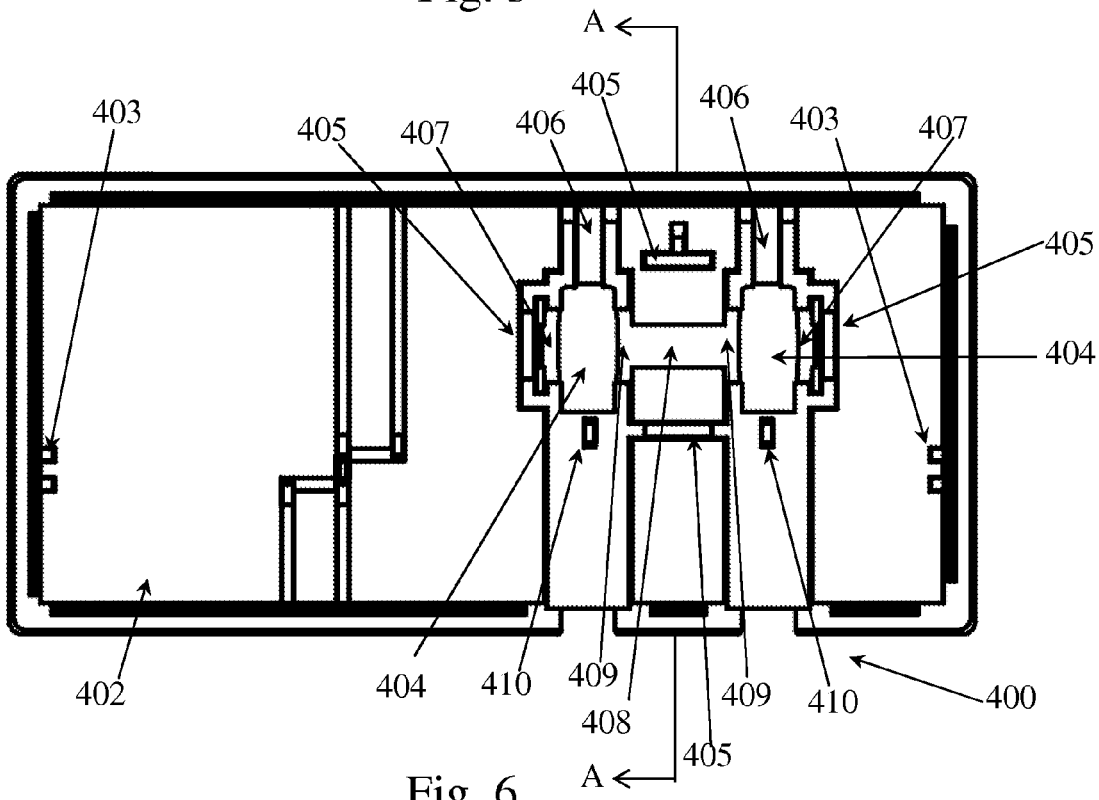
FIG. 6 is a top view diagram of the lower case of the electric device according to the present invention.
Figure 7:
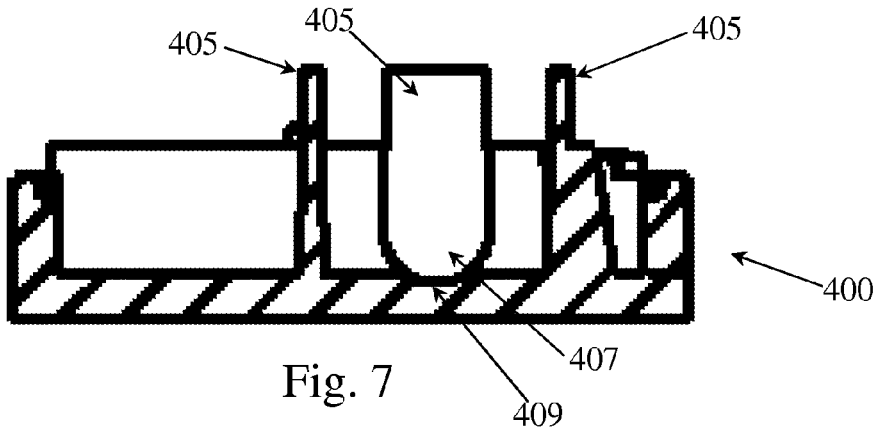
FIG. 7 is a sectional view taken along lines A-A of FIG. 6 according to the present invention.

With reference to FIGS. 6 and 7, the lower case 400 includes a base 402, two fasteners 403 formed at the perimeter of the base 402 to fix the printed circuit board (PCB) 500, two through holes 404 formed through the base 402 for the rotatable rack 300 being inserted through the lower case 400, four upward-projected vertical walls 405 formed on the base 402 around the through holes 404 to be received by the fixing member 200, two narrow receptacles 406 formed near the through holes 404 to receive the rotatable rack 300 when the rack 300 is rotated to be parallel to the lower surface of the lower case 400, and two concave receptacles 407 formed adjacently to the lower part of the vertical walls 405 to support the rotatable rack 300. A concave groove 408 is formed between the two through holes 404. Two notches 409 are formed on opposite ends of the concave groove 408 and the shape of the notches 409 is similar to that of the concave receptacles 407. Preferably, the shape of the notches 409 and the concave receptacles 407 are U-shaped. Two protrusions 410 are formed on the upper surface of the lower case 400 opposite to the slots 401 in the lower surface.

Figure 4:
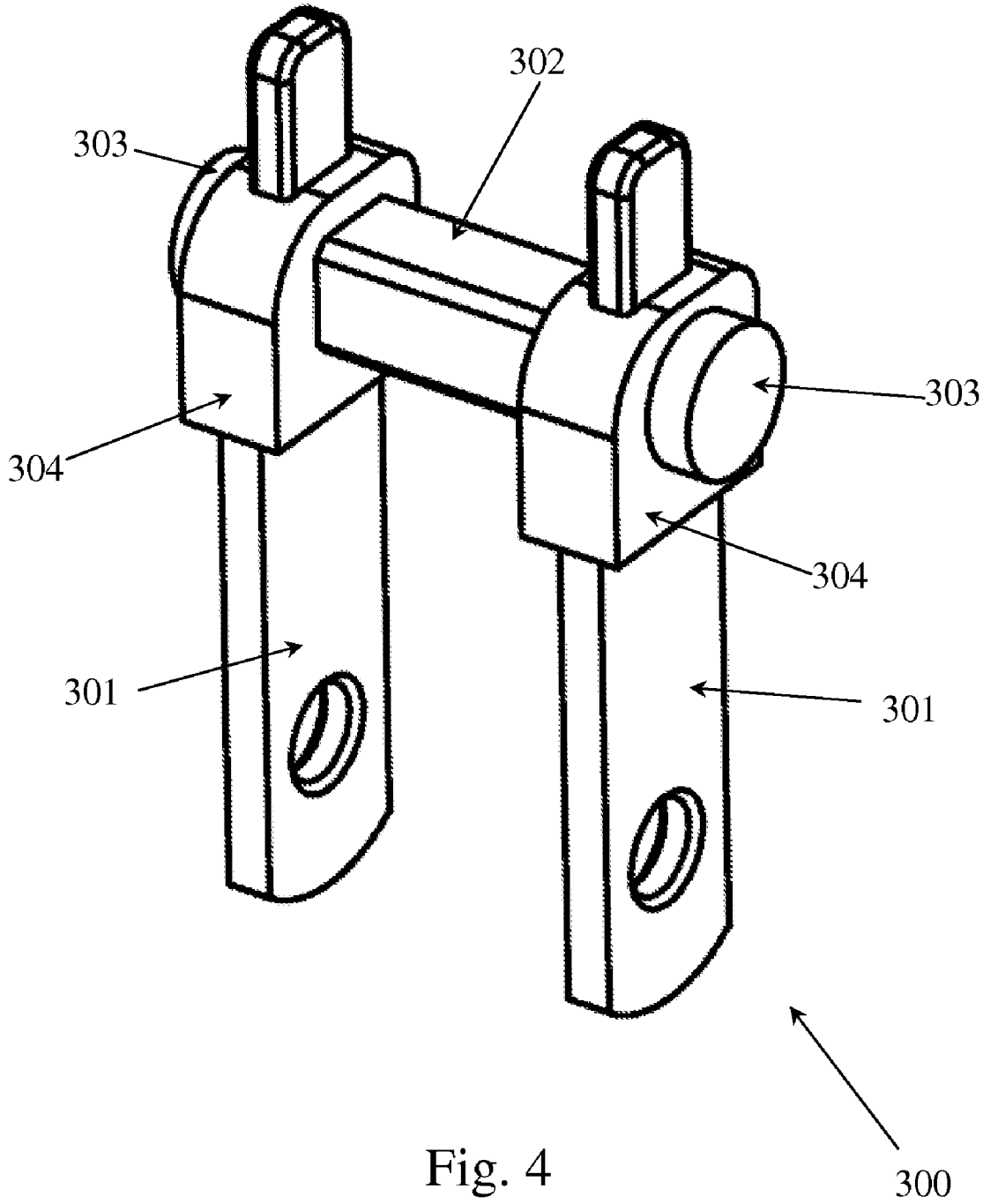
FIG. 4 is a diagram of the rotatable rack of the electric device according to the present invention.

With reference to FIG. 4, the rotatable rack 300 includes a pivot 302, two seats 304 formed on opposite ends of the pivot 302, two prongs 301 fixed on the seats 304 respectively, and two circular protrusions 303 fixed to the seats 304 on the outer side along the axis of the pivot 302. Each seat 304 has a slot (not shown) extending therethrough vertically to the axis of the pivot 302, and an opening (not shown) extending therethrough parallel with the axis of the pivot 302 and communicating with the slot (not shown). One end of each prong 301 is received and fixed in the slot (not shown), while the other end extends out and passes through the corresponding slots 401 of the lower case 400. The rotatable rack 300 is placed in the space between two of the four vertical walls 405 on the lower case 400 and the longer ends of the prongs 301 are inserted into the two through holes 404 in the lower case 400 when the electric device 10 is assembled. Furthermore, the pivot 302 of the rack 300 is received and supported by the two notches 409 in the lower case 400 while the circular protrusions 303 of the rack 300 are received and supported by the concave receptacles 407 in the lower case 400. Therefore, the pivot 302 can be rotated around the axis of the pivot 302 and can slip smoothly into and out of the concave groove 408 in the lower case 400, while the circular protrusions 303 can be rotated around the axis of the pivot 302 along with the pivot 302 when the rack 300 is being rotated.

Figure 2:
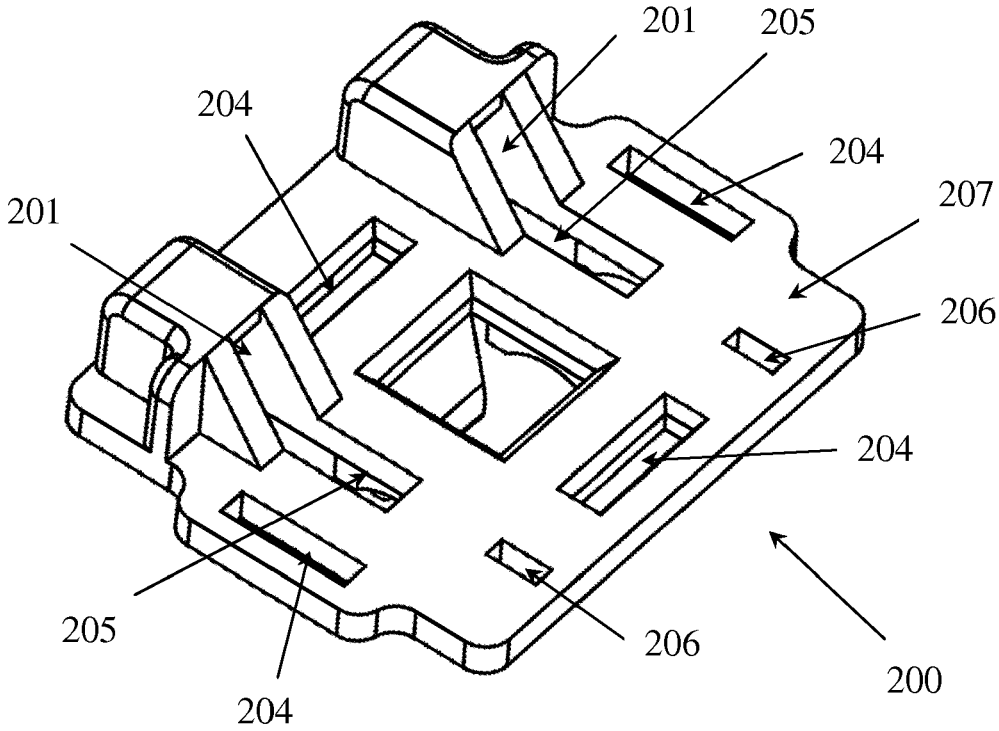
FIG. 2 is a diagram of the fixing member of the electric device according to the present invention.
Figure 3:
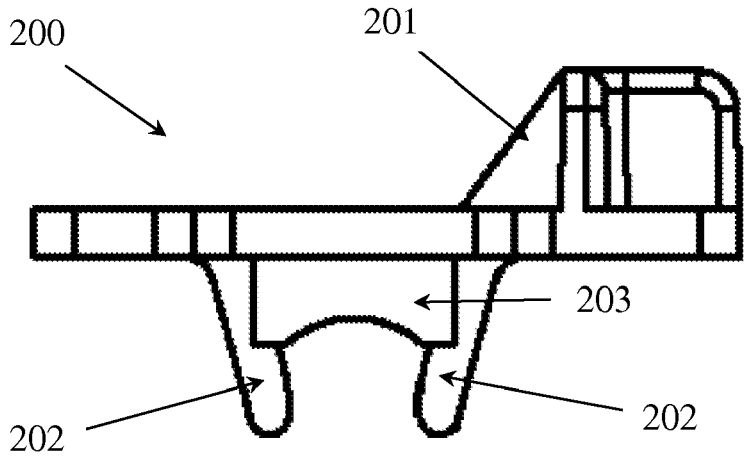
FIG. 3 is a side view diagram of the fixing member of the electric device according to the present invention.

With reference to FIG. 2 and FIG. 3, the fixing member 200 includes a plate 207, two clamping fixtures 202 extending downward from the plate 207, four slots 204 formed along the perimeter of the plate 207, four brackets 203 formed on the lower surface of the plate 207 corresponding to the circular protrusions 303 and the pivot 302 of the rack 300, and two receiving parts 201 formed on the upper surface of the plate 207. Two slots 205 are formed below and in front of the two receiving parts 201 on the plate 207, and thereby the slots 205 and the receiving parts 201 may receive the shorter ends of the prongs 301 when the electric device 10 is assembled and when the prongs 301 are being rotated. The four slots 204 are formed in the plate 207 of the fixing member 200 to receive the upward-projected vertical walls 405 on the lower case 400, while the four brackets 203 are formed on the lower surface of the plate 207 of the fixing member 200 to mount onto both the circular protrusions 303 and the pivot 302 of the rotatable rack 300. Two holes 206 are formed on two opposite sides of one of the four slots 204 to receive the protrusions 410 of the lower case 400. The clamping fixtures 202 clamp the pivot 302 of the rotatable rack 300 to prevent the rack 300 from rotating away from the predetermined position. The distance between the end parts of the two clamping fixtures 202 can be changed by the pivot 302 when the rotatable rack 300 is being rotated because the clamping fixtures 202 are flexible.

Figure 8:
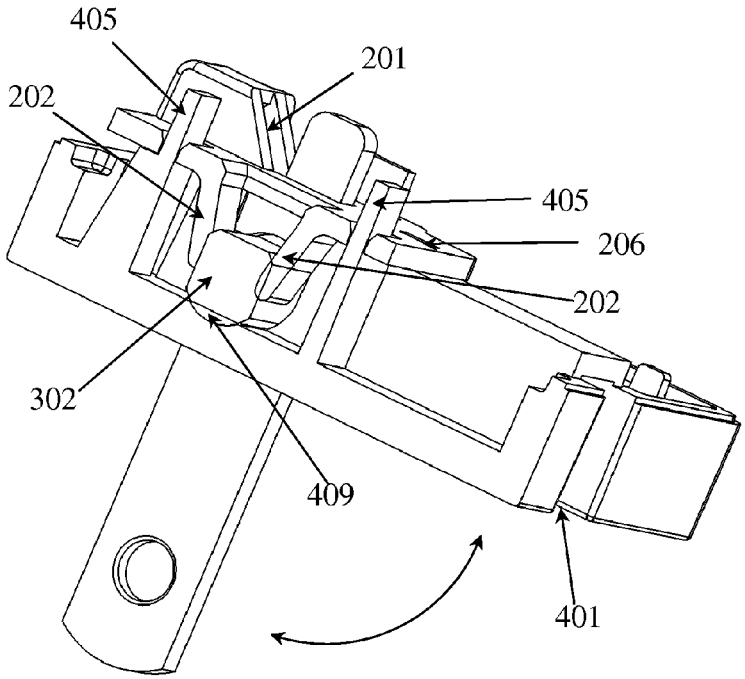
FIG. 8 illustrates the rotation mechanism of the rotatable plug of the electric device according to the present invention.

With reference to FIG. 8, the prongs 301 can be rotated around the axis of the pivot 302 from a hidden position at which the prongs 301 are parallel to the lower surface of the lower case 400 and received in the corresponding slots 401 to a vertical position at which the prongs 301 are vertical to the lower surface of the lower case 400 and exposed out of the lower case 400, and vice versa. The shorter ends of the prongs 301 pass through the receiving parts 201 and the slots 205 in the fixing member 200 first, then enter the narrow receptacles 406 in the lower case 400 and are received therein while the longer ends of the prongs 301 enter the slots 401 in the lower surface of the lower case 400 and are received therein as the prongs 301 are being rotated from the vertical position to the hidden position. Moreover, the pivot 302 is substantially a rectangular prism. Therefore, the two clamping fixtures 202 can clamp the pivot 302 on two opposite planes of the rectangular prism to hold the prongs 301 in position and prevent the prongs 301 from rotating away from the vertical position when the prongs 301 are in the vertical position. When the prongs 301 are being rotated back to the hidden position, the edge of the pivot 302 are slipping into the concave groove 408 in the lower case 400 and passing therethrough. The physical flexibility of the clamping fixtures 202 may make it easy and effort-saving to rotate the pivot 302 and the prongs 301 from the vertical position to the hidden position. After being rotated back to the hidden position, the pivot 302 is clamped by the clamping fixtures 202 on the other two opposite planes of the rectangular prism to prevent the prongs 301 from rotating out of the lower surface of the lower case 400. Similarly, when the prongs 301 are to be rotated to the vertical position, the physical flexibility of the clamping fixtures 202 make it easy and effort-saving to rotate the pivot 302 and the prongs 301 from the hidden position to the vertical position.

Figure 9:
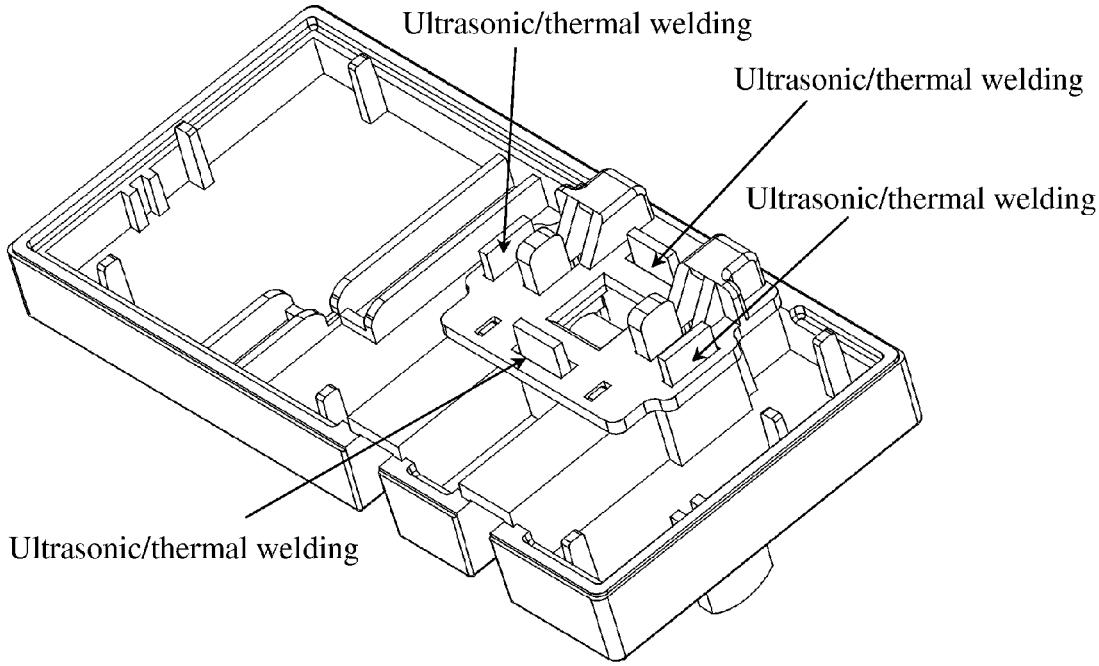
FIG. 9 illustrates the assembling procedure of the electric device according to the present invention.

Furthermore, the pivot 302 and the circular protrusions 303 are sandwiched in between the brackets 203 of the fixing member 200 and the notches 409 and the concave receptacles 407 of the lower case 400, and the slots 204 in the fixing member 200 and the vertical walls 405 on the lower case 400 are coupled by ultrasonic welding or thermal welding in one embodiment of the present invention, as shown in FIG. 9. Therefore, the axis of rotation will not be shifted away from the predetermined position. The robustness of the rotatable plug can be increased because the fixing member 200 and the lower case 400 are coupled together via the slots 204 and the vertical walls 405. Accordingly, the rotatable plug mechanism utilizing the clamping fixtures 202 and the combination between the slots 204 and the vertical walls 405 in the present invention will be much more stable than prior art utilizing springs. Moreover, the contact surfaces of the brackets 203, the notches 409, the concave receptacles 407, the pivot 302, and the circular protrusions 303 may be polished to reduce the friction therebetween and thereby the rotatable rack 300 can be rotated more smoothly. Accordingly, the present invention provides an electric device 10 with an effort-saving, receivable, durable, and rotatable plug which can meet the safety requirements. In one embodiment of the present invention, the electric device 10 may be an electric power connector such as a power supply, a battery charger, a transformer, an adapter or any other kinds of electric products which need an electric plug.

With reference to FIG. 10, in the assembling process of the present invention, firstly a lower case 400 is pre-prepared and then the rotatable rack 300 is inserted vertically into the two through holes 404 in the lower case 400. Then, the fixing member 200 is mounted onto the rotatable rack 300 by inserting the shorter end of the rack 300 into the two slots 205 in the fixing member 200 and the four upward-projected vertical walls 405 on the lower case 400 into the four slots 204 in the fixing member 200, and the slots 204 and the vertical walls 405 are assembled by ultrasonic welding or thermal welding to meet the safety requirements. Subsequently, the printed circuit board (PCB) 500 is attached onto the lower case 400. Finally, the upper case 100 is assembled with the lower case 400 by ultrasonic welding to form the electric device 10.

The foregoing description is a preferred embodiment of the present invention. It should be appreciated that this embodiment is described for purposes of illustration only, not for limiting, and that numerous alterations and modifications may be practiced by those skilled in the art without departing from the spirit and scope of the invention. It is intended that all such modifications and alterations are included insofar as they come within the scope of the invention as claimed or the equivalents thereof.

What is claimed is:

1. A structure of an electric device, comprising:

an upper case;

a lower case having two through holes, two plug receiving slots opened in one end, and two receptacles formed therein, said lower case being engaged with said upper case;

a plug having a first end, a second end and a pivot, said first end being inserted into said through holes of said lower case, wherein said first end of said plug is received in said plug receiving slots of said lower case and said second end of said plug is received in said receptacles of said lower case when said plug is rotated to a hidden position, wherein said first end of said plug is vertical to a lower surface of said lower case and is exposed out of said lower case when said plug is rotated to a vertical position;

a fixing member having two slots formed therein to be inserted by said second end of said plug and two clamping fixtures formed on a lower surface thereof to clamp said pivot and fix said plug when said plug is at said hidden position and when said plug is at said vertical position; and a circuit board attached onto said lower case.

2. The structure of claim 1, wherein said electric device comprises a power supply, a battery charger, a transformer, or an adapter.

3. The structure of claim 1, wherein said lower case further comprises two notches and two concave receptacles formed therein to support said plug.

4. The structure of claim 3, wherein said notches and said concave receptacles are U-shaped.

5. The structure of claim 1, wherein said lower case further comprises a Concave groove formed between said through holes.

6. The structure of claim 1, wherein said pivot comprises a rectangular pivot to be camped by said clamping fixtures of said fixing member.

7. The structure of claim 6, wherein said plug further comprises two seats formed on opposite ends of said pivot and two circular protrusions fixed to said seats.

8. The structure of claim 1, wherein said fixing member further comprises two receiving parts formed on the upper surface thereof, said receiving parts and a portion of said slots in said fixing member receiving said second end of said plug when said plug is being rotated.

9. The structure of claim 1, wherein said fixing member further comprises four brackets formed on the lower surface thereof to mount onto said plug.

10. The structure of claim 1, wherein said fixing member further comprises four wall receiving slots formed around the perimeter of said fixing member.

11. The structure of claim 10, wherein said lower case further comprises four vertical walls formed thereon to be inserted into said wall receiving slots.

12. The structure of claim 11, wherein said wall receiving slots and said vertical walls are coupled together by ultrasonic welding or thermal welding.

* * * * *